US005692254A

United States Patent [19]

Boettcher

[11] Patent Number: 5,692,254

[45] Date of Patent: Dec. 2, 1997

[54] WHEELED LIFT APPARATUS FOR LIFTING A PERSON

[76] Inventor: Walter F. Boettcher, Box 175, R.R. 1, Cyrus, Minn. 56323

[21] Appl. No.: 699,545

[22] Filed: Aug. 19, 1996

[51] Int. Cl.[6] ..... A61G 1/00

[52] U.S. Cl. ..... 5/86.1; 5/611

[58] Field of Search ..... 5/11, 611, 81.1 R, 5/83.1, 86.1; 296/20; 254/7 R, 7 C

[56] References Cited

U.S. PATENT DOCUMENTS

| | | | |
|---|---|---|---|
| 2,564,333 | 8/1951 | Kelly | 296/20 |
| 2,747,919 | 5/1956 | Ferneau et al. | 5/611 X |
| 3,178,732 | 4/1965 | Stibitz | 5/81 |
| 4,685,159 | 8/1987 | Oetiker | 5/611 X |
| 4,760,615 | 8/1988 | Furniss | 5/611 |
| 4,776,047 | 10/1988 | DiMatteo | 5/81 |
| 5,323,498 | 6/1994 | Fellay et al. | 5/86.1 |
| 5,495,914 | 3/1996 | DiMucci et al. | 5/611 X |
| 5,572,756 | 11/1996 | Muuranen et al. | 296/20 X |

*Primary Examiner*—Michael F. Trettel
*Attorney, Agent, or Firm*—David A. Lingbeck

[57] ABSTRACT

A wheeled lift apparatus for lifting a person includes a base frame mounted upon transport wheels, two pairs of support arms each having an end pivotally attached to the base frame and having an opposite end pivotally attached to a support frame disposed above the base frame and supporting a support platform which is capable of supporting a person in the prone position. The wheeled lift apparatus also includes a two directional motor, a screw jack connected to the motor and to a bracket attached to the support frame, and a control unit having two momentary switches, one for energizing the motor to effect raising of the support platform and the other for energizing the motor to effect lowering of the support platform. The wheeled lift apparatus can be stood upright upon the support wheels and upon a pair of feet members and conveniently stored out of the way and allows just one person to operate the wheeled lift apparatus and further saves the helper from having to try to lift the disabled person to either the bed or the sofa.

3 Claims, 5 Drawing Sheets

WHEELED LIFT APPARATUS FOR LIFTING A PERSON

BACKGROUND OF THE INVENTION

This invention relates to a wheeled lift apparatus for lifting a person who cannot get up under one's own power. The person may be someone who is physically disabled, or who has fallen and cannot get up.

A stretcher is used by paramedics to carry and transport a person who cannot move or get up for various reasons. The stretcher has a wheeled base, scissor-like support arms, a bed-like platform mounted upon the support arms which are used to raise and lower the bed-like platform, and means for locking the bed-like platform at an elevated position. At least two people are needed to raise the bed-like platform to the desired elevated position. Other prior art describes lifting a patient while already being on the bed so that the bedding can be replaced without the patient having to get up out of bed.

One known prior art is an EVERSIBLE LIFTING DEVICE, U.S. Pat. No. 3,178,732, issued on Apr. 20, 1965 and invented by G. R. Stibitz, which comprises an eversible sleeve and fluid-moving means for forcing fluid into the sleeve causing the sleeve to evert under a person.

Another known prior art is a BEDRIDDEN PATIENT HANDLING AID, U.S. Pat. No. 5,323,498, issued on Jun. 28, 1994 and invented by Gilbert Fellay, which comprises a frame mounted on two pairs of wheels combined with retractable legs and supporting a platform including individual flat strips for raising the patient up from the bed, and further comprises a control unit for controlling the flat strips.

Another known prior art is a MULTIPLE FUNCTION INVALID BED ARRANGEMENT, U.S. Pat. No. 4,776,047, which comprises a first support, a flexible sheet of material, means for pulling said flexible sheet to and beyond an edge of the first support, means for positioning a second support at an edge of the first support, the pulling means comprising rollers carrying the flexible sheet.

None of the prior art describes a lift apparatus for lifting a person which can be used and controlled by just one individual other than the person needing to be lifted and which can be lowered substantially to ground level so that a person who may have fallen on the ground or floor can be moved over onto the support platform and then raised to either the level of a sofa or a bed and then moved from the lifting apparatus to the sofa or bed.

SUMMARY OF THE INVENTION

The present invention relates to a wheeled lift apparatus for lifting a person which comprises a base frame mounted to two pairs of transport wheels, another pair of support wheels being mounted at the corners of one end of the base frame, a pair of support arms each of which has one end pivotally attached to the base frame and an opposite end pivotally attached to the underside of a support platform, a motor mounted upon the base and attached to a jack screw which has an end fastened to a bracket on the underside of the support platform for raising and lowering the support platform, a control unit to energize the motor, a pair of feet members which extend outwardly from the front end of the base frame for standing the wheeled lift apparatus upright, and a handle member which is attached to a pair of brackets which are attached to the base frame.

One objective of the present invention is to provide a wheeled lift apparatus for lifting a person which can be easily operated by a single person.

Another objective of the present invention is to provide a wheeled lift apparatus which can be stored upright essentially out of the way.

Also, another objective of the present invention is to provide a wheeled lift apparatus for lifting a person which can be lowered substantially to the ground or floor so that a person who is lying on the ground can be moved onto the support platform without having to elevate the person.

Yet, another objective of the present invention is to provide a wheeled lift apparatus for lifting a person which can be conveniently raised and lowered through a control unit so that the person can be moved to a bed or even to a vehicle if necessary for transportation to a medical center.

Further objectives and advantages of the present invention will become apparent as the description proceeds and when taken in conjunction with the accompanying drawings wherein:

DETAILED DESCRIPTION OF THE INVENTION

Figure 1:
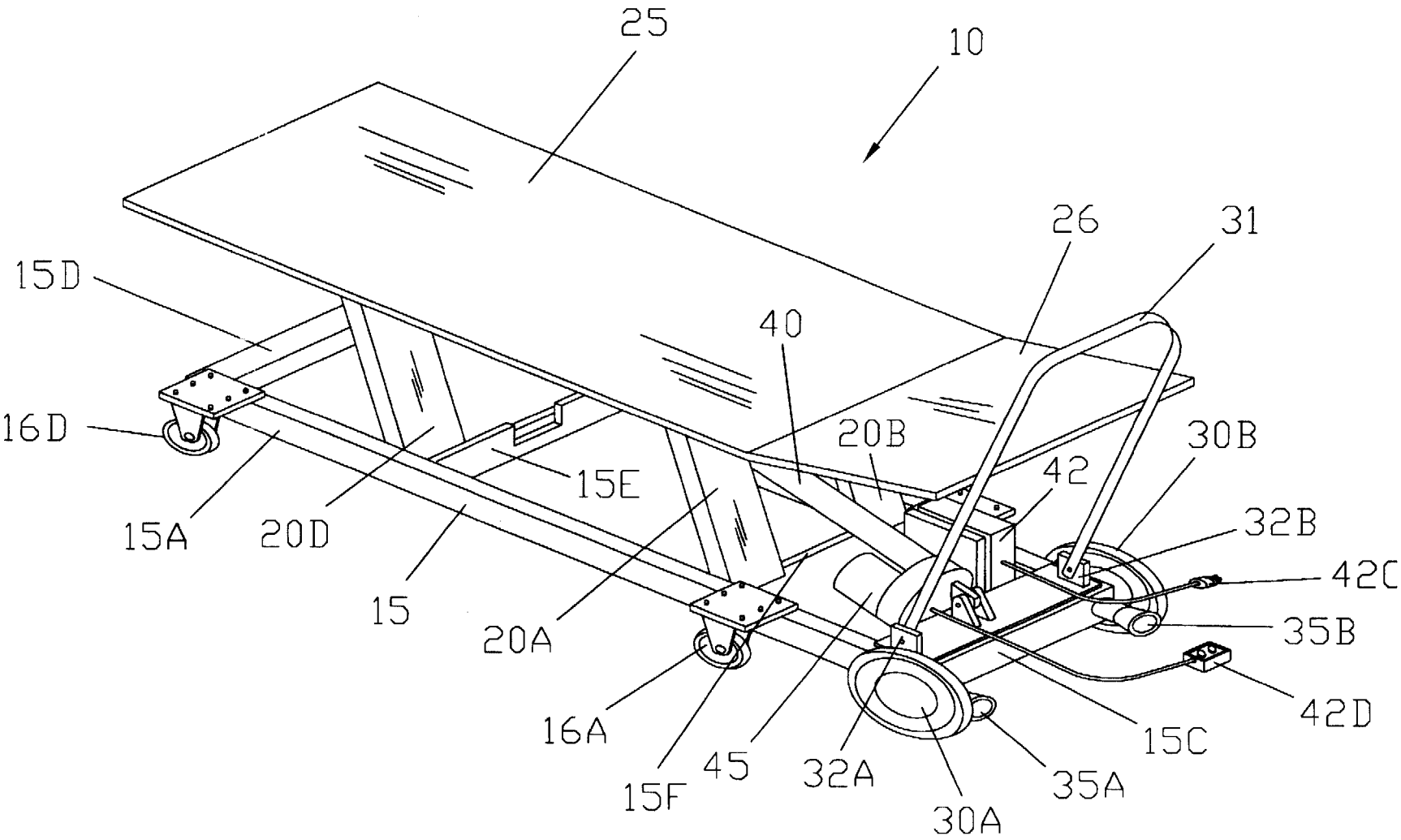
FIG. 1 is a perspective view of the wheeled lift apparatus for lifting a person.
Figure 2:
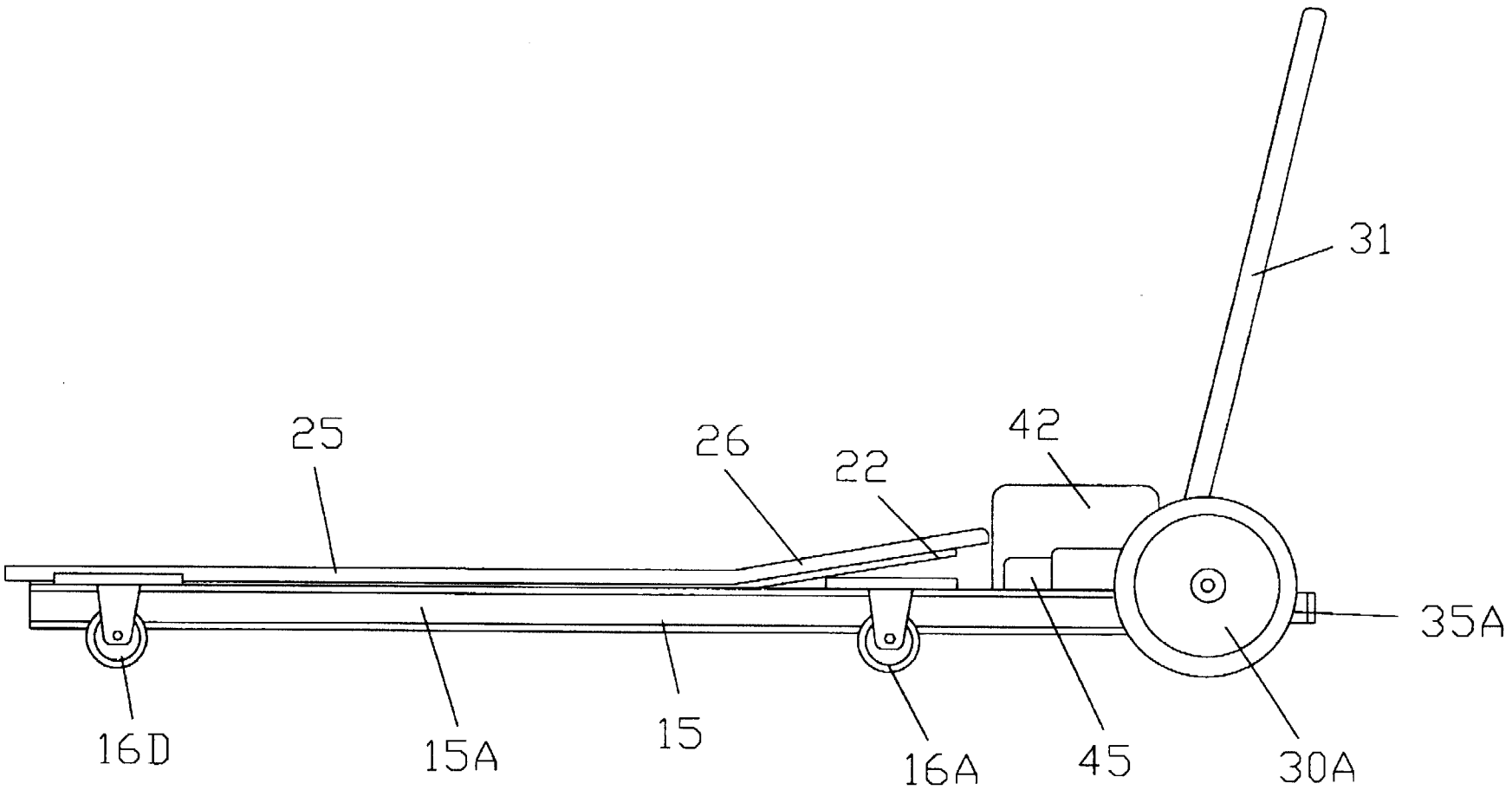
FIG. 2 is a side elevational view of the wheeled lift apparatus for lifting a person in a lowered position.

Referring to the drawings in FIGS. 1–5, in particular, the wheeled lift apparatus 10 for lifting a person comprises a generally rectangular base frame 15 having a front end 15C, back end 15D, and two side ends 15A–B and further being mounted upon two pairs of transport wheels 16A–D which are caster wheels, one pair of which are swivelly attached at the ends of a first cross member 15C which interconnects the side ends 15A–B near the front end of the base frame 15 and the other pair being swivelly attached at the ends of a second cross member 15D which interconnects the side ends 15A–B near the back end of the base frame 15, the caster wheels essentially being disposed beyond the side ends 15A . B of the base frame 15. The wheeled lift apparatus 10 further includes two pairs of support arms 20A–D, each pair having a respective end which is pivotally attached to a respective elongate member 15E–F interconnecting the side ends 15A–B of the base frame 15 with the support arms 20A–D in each pair being spaced apart relative to the respective side end. The opposite ends of the support arms 20A–D are pivotally attached with bolts to a generally rectangular support frame 22 which includes two side ends preferably made of angle iron. A support platform having 25 a front end 25A and being adapted to comfortably support a person in the prone position, is fixedly mounted upon the support frame 22. A head support member 26 having a width and length to comfortably support a head has a back end which is hingedly attached at the front end 25A of the support platform 22, the head support member 26 being capable of folding over upon the support platform 25 and extending at an angle relative to and beyond the front end of the support platform 25.

As shown in FIGS. 1–5, two support wheels 30A–B are mounted at the corners of the front end 15C of the base frame 15 and engage the surface only when the base frame 15 and support platform 25 are in an upright position. The two support wheels 30A–B allow the user to move and support the wheeled lift apparatus 10 while it is in an upright storable position. To aid in moving the wheeled lift apparatus 10, a U-shaped handle member 31 has ends which are fastened with bolts to a pair of brackets 32A–B each of which is attached at a respective corner of the front end 15C of the base frame 15 with the closed end of the U-shaped handle member 31 being disposed forward of the support platform 25 for easy access by the user who can either push or pull the wheeled lift apparatus 10. To further help support the wheeled lift apparatus 10 in an upright position, two feet members 35A–B extend from the corners of the front end 15C of the base frame 15 in general horizontal alignment thereto with the feet members 35A–B essentially resting upon the ground or surface only when the wheeled lift apparatus 10 is in an upright position.

Figure 3:
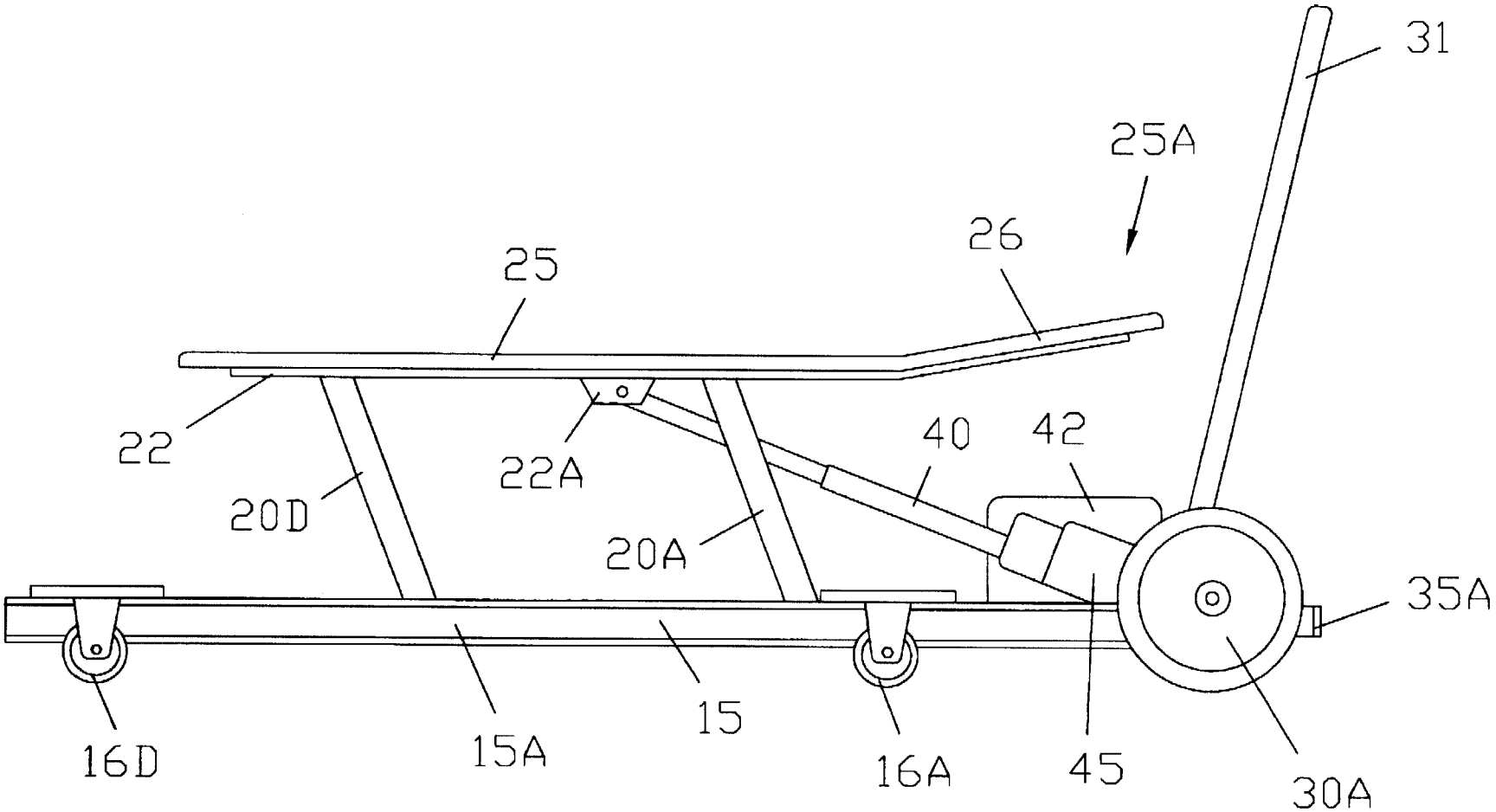
FIG. 3 is a side elevational view of the wheeled lift apparatus for lifting a person in a raised position.
Figure 4:
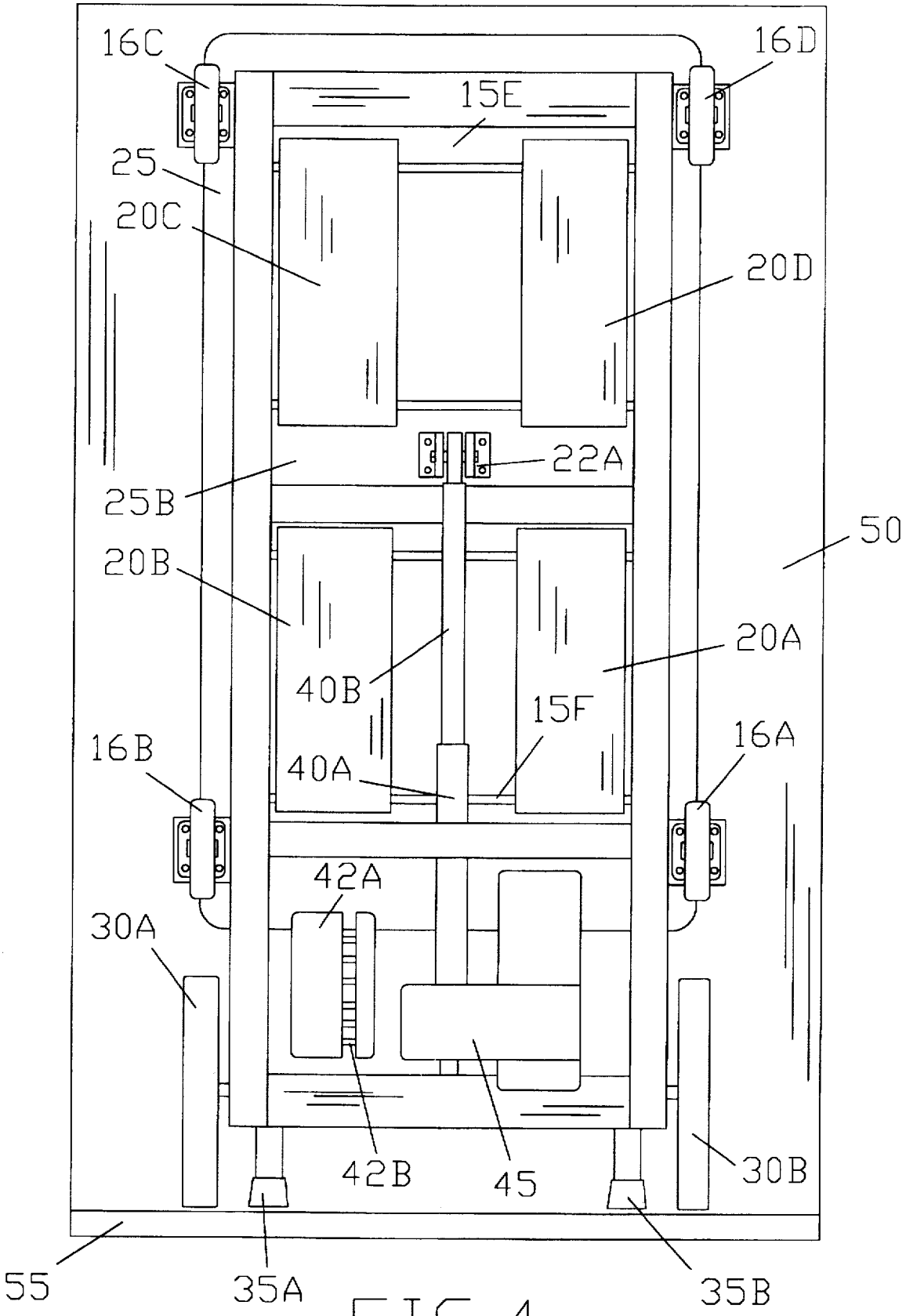
FIG. 4 is a rear view of the wheeled lift apparatus in an upright storable position.
Figure 5:
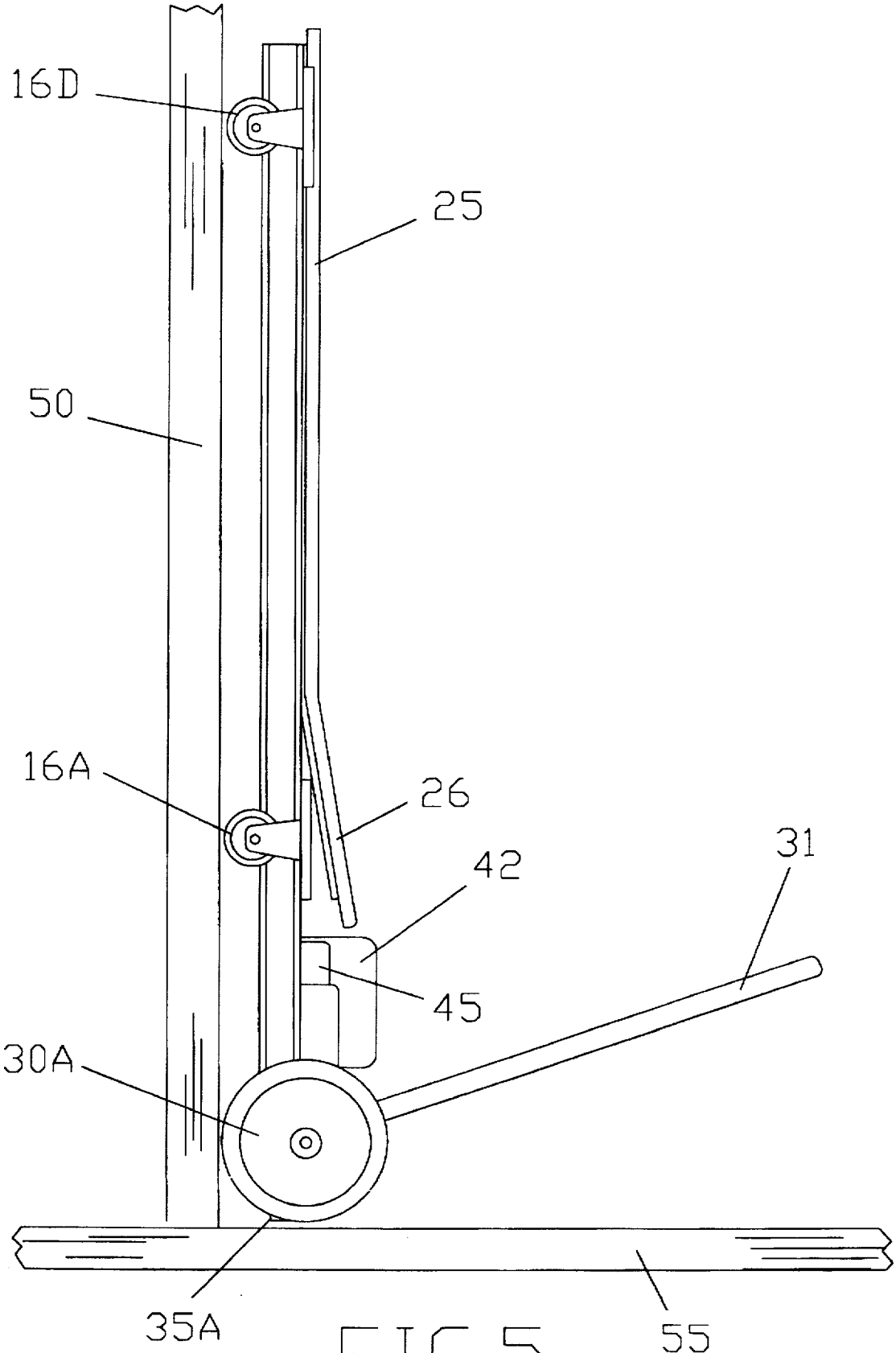
FIG. 5 is a side view of the wheeled lift apparatus in an upright storable position.

As shown in FIGS. 1,3,& 4, to raise and lower the support platform 25, a screw jack 40 having a conventional tubular housing 40A with a threaded bore extending therethrough and having a threaded shaft 40B which is threadable in and out of the threaded bore through one end of the tubular housing 40A, is connected to a motor shaft of a motor 45 which is fastenably mounted upon the first cross member 15C with the end of the housing 40A opposite to the end through which the threaded shaft 40B extends being pivotally fastened with bolts to a bracket mounted upon the first cross member 15C. The motor shaft is connected to one end of the threaded shaft 40B for rotation therewith. The other end of the threaded shaft 40B is fastened with a bolt to a bracket 22A which is fixedly attached to and centrally disposed along the support frame 22.

The motor 45 is preferably a two directional motor which can be rotated in two directions and can be a battery-operated motor or more preferably an electrically-operated motor which has an electrical cord 42C which is taken up and stored by a conventional retractable cord unit 42 which includes a housing 42A and a spring-loaded spindle 42B about which the electrical cord 42C is retractably-carried about, the motor 45 being energized by a control unit 42D which includes a control box having a cord extending therefrom and connected to the motor 45 and further having a pair of momentary switches which are essentially contact buttons, one for energizing the motor 45 to rotate the motor shaft in one direction such as to thread out the threaded shaft 40B to raise the support platform 25, and one for energizing the motor 45 to rotate the motor shaft in an opposite direction such as to thread in the threaded shaft 40B to lower the support platform 25.

To operate and use the wheeled lift apparatus 10, the user positions the base frame 15 generally parallel to the ground or floor with the caster wheels 16A–B resting upon the ground or floor; then moves the wheeled lift apparatus 10 beside the person who may be lying on the ground unable to get up; next lowers the support platform 25 substantially to the surface by pushing the button or switch on the control box 42D which energizes the motor 45 to lower the support platform 25; then helps the disabled person onto the support platform 25 with the disabled person's head being directed to the front end 25A of the support platform 25 so that the person can rest one's head on the head support member 26; next by pushing the other button on the control box 42D, raises the support platform 25 to the desired height which may be the bed or the sofa so that the person can be moved gently over onto the sofa or bed; then lowers the support platform 25 to the surface and lifts the back end 15D of the base frame 15 up so that the base frame 15 and the support platform 25 are in an upright position with the two support wheels 30A–B resting upon the surface; and by using the handle member 31, pushing or pulling the upright wheeled lift apparatus 10 on the support wheels 30A–B to a storage space out of the way but yet readily accessible.

Various changes and departures may be made to the invention without departing from the spirit and scope thereof. Accordingly, it is not intended that the invention be limited to that specifically described in the specification or as illustrated in the drawings but only as set forth in the claims.

What is claimed is:

1. A wheeled lift apparatus for lifting a person comprising:

a base frame having a front end, back end, and two side ends, and a bracket attached thereto, said base frame being mounted upon a plurality of transport wheels and being disposable in a generally horizontally-operative position;

a plurality of support arms each of which has an end pivotally attached to said base frame;

a support frame mounted upon said support arms;

a support platform mounted upon said support frame and having a front end and further being adapted to comfortably support a person in a prone position;

a means to raise and lower said support platform relative to said base frame and to a surface, said means for raising and lowering said support platform including a motor, a screw jack and a control unit for energizing said motor, said screw jack including a tubular housing and a threaded shaft extending in said tubular housing and having one end connected to said motor and another end connected to said bracket;

a handle member attached to said base frame for moving said wheeled lift apparatus; and a means of supporting said wheeled lift apparatus in an upright position for convenient storage of said wheeled lift apparatus.

2. A wheeled lift support apparatus for lifting a person as described in claim 1, wherein said control unit includes a control box having two momentary switches, one for energizing said motor to rotate said threaded shaft in one direction for raising said support platform, and the other for energizing said motor to rotate said threaded shaft in an opposite direction for lowering said support platform.

3. A wheeled lift support apparatus for lifting a person comprising:

a base frame having a front end, back end, and two side ends, said base frame being mounted upon a plurality of transport wheels and being disposable in a generally horizontally-operative position;

a plurality of support arms each of which has an end pivotally attached to said base frame;

a support frame mounted upon said support arms;

a support platform mounted upon said support frame and having a front end and further being adapted to comfortably support a person in a prone position;

a means to raise and lower said support platform relative to said base frame and to a surface;

a handle member attached to said base frame for moving said wheeled lift apparatus; and a means of supporting said wheeled lift apparatus in an upright position for convenient storage of said wheeled lift apparatus, said means for supporting said wheeled lift apparatus in an upright position comprising a plurality of support wheels mounted to said front end of said base frame for engaging a surface to support said base frame and said support platform in an upright position and to allow a user to move said wheeled lift apparatus while being in an upright position, said means for supporting said wheeled lift apparatus in an upright position further including a pair of feet members extending outwardly from said front end of said base frame and being ground engageable only when said wheeled lift apparatus is in an upright position.

* * * * *